US007637852B2

(12) United States Patent
Hoole

(10) Patent No.: US 7,637,852 B2
(45) Date of Patent: Dec. 29, 2009

(54) APPARATUS AND METHOD FOR CHANGING BARBELL WEIGHTS

(76) Inventor: Richard J. Hoole, 102 Cunningham Dr., New Smyrna Beach, FL (US) 32168

( * ) Notice: Subject to any disclaimer, the term of this patent is extended or adjusted under 35 U.S.C. 154(b) by 182 days.

(21) Appl. No.: 11/784,351

(22) Filed: Apr. 6, 2007

(65) Prior Publication Data

US 2008/0248930 A1 Oct. 9, 2008

(51) Int. Cl.
*A63B 21/078* (2006.01)

(52) U.S. Cl. ..... 482/104

(58) Field of Classification Search ..... 482/104, 482/106–108, 132; D21/686
See application file for complete search history.

(56) References Cited

U.S. PATENT DOCUMENTS

| | | | | | |
|---|---|---|---|---|---|
| 2,971,769 | A * | 2/1961 | Gaddis | 280/79.11 |
| 3,542,157 | A * | 11/1970 | Noah | 188/32 |
| 4,529,198 | A | 7/1985 | Hettick, Jr. | |
| 4,773,642 | A * | 9/1988 | Cruz | 482/104 |
| 4,911,270 | A * | 3/1990 | Hudson | 188/32 |
| 4,971,318 | A | 11/1990 | Tracy | |
| 5,772,561 | A | 6/1998 | Hayden | |
| 5,954,619 | A * | 9/1999 | Petrone | 482/104 |
| 6,039,678 | A | 3/2000 | Dawson | |
| 6,123,651 | A | 9/2000 | Ellenburg | |
| 6,758,795 | B2 | 7/2004 | Barber | |
| D495,383 | S * | 8/2004 | Ceppo | D21/686 |
| D528,612 | S * | 9/2006 | Black | D21/686 |
| 7,285,077 | B1 * | 10/2007 | Marx | 482/104 |
| 2004/0162197 | A1 | 8/2004 | Towley, III et al. | |
| 2006/0116255 | A1 | 6/2006 | Scrivens | |
| 2006/0205573 | A1 | 9/2006 | Savage | |

* cited by examiner

*Primary Examiner*—Loan H Thanh
*Assistant Examiner*—Allana Lewin
(74) *Attorney, Agent, or Firm*—Paul S. Rooy PA

(57) ABSTRACT

An apparatus and method for changing barbell weights. The apparatus includes at least one stand having a ramp sloping upwards to a cradle. The cradle is sized to hold a circular barbell weight, and slopes downward from a cradle inner edge to a cradle outer edge. When a barbell is supported in the stand, only an innermost weight at each barbell end rests against the cradle floor; the other weights all depend from the bar and are easily slid off of, and onto, the bar. Thus, when the barbell rests on the stand(s), weights may be quickly and easily changed. After the desired weights have been changed, the barbell is rolled out of the cradle(s), down the ramp(s), and off of the stand(s). Method steps include rolling the barbell onto one or more stands, changing weights as desired, and rolling the barbell off of the stand(s).

11 Claims, 4 Drawing Sheets

APPARATUS AND METHOD FOR CHANGING BARBELL WEIGHTS

BACKGROUND OF THE INVENTION

1. Field of the Invention

This invention relates to barbells, and in particular to an apparatus and method for changing barbell weights.

2. Background of the Invention

Weightlifting is a popular and effective way to strengthen muscles. Barbells are used frequently in this type of exercise. As may be observed in FIGS. 5-9, a typical barbell 40 comprises a bar 42 upon which weights 44 are slid. A collar 46 serves to prevent weights 44 from sliding off bar 42.

A plurality of weights 44 may be slid onto bar 42, depending on how much total weight is to be employed in the particular exercise being conducted. Thus, the ability of quickly and easily changing weights 44 is advantageous in setting up a barbell 40 for exercise.

However, where barbell 40 rests on the ground, friction between weights 44 and the ground makes removal and installation of weights 44 on bar 42 difficult. Typically, an individual must lift up an end of bar 44 with one hand, and slide weights 44 on or off with the other hand. This can be rather difficult for smaller individuals or children due to the physical strength required to perform this maneuver. Thus, it would be desirable to provide an apparatus and method for changing barbell weights which permits the quick and easy removal and installation of weights on a bar.

Existing Designs

A number of approaches have been proposed to achieve this objective. U.S. Pat. Nos. 6,758,795, 6,039,678, 4,971,318, 4,531,728 and 4,529,198 were granted Barber, Dawson, Tracy, Wright and Hettick, Jr. respectively for apparatuses which permitted weights to be added and removed from bars. The application of Towley, III published as U.S. Pat. No. 2004/0162197, was directed towards the same purpose. Notably, Barber '795 taught a bar incorporating bellows-like containers at each end which could be filled with varying amounts of water to achieve the weight desired. These apparatuses suffered from the drawback that non-standard weights were required to be used with the inventions they taught. Thus, standard, existing weights could not be used according to these patents.

U.S. Pat. Nos. 6,123,651 and 5,772,561 were awarded Ellenburg and Hayden respectively, and U.S. patent applications, published as 2006/0205573 and 2006/0116255 by Savage and Scrivens respectively, taught barbell and dumbbell stands. While these stands appeared capable of supporting barbells and/or dumbbells, no provision for quickly and easily changing weights was disclosed.

SUMMARY OF THE INVENTION

Accordingly, it is an object of the present invention to provide an apparatus and method for changing barbell weights which permits weights to be quickly and easily removed and installed on a bar. Design features allowing this object to be accomplished include a stand incorporating a ramp leading up to a cradle, which a barbell can be rolled onto. Advantages associated with the accomplishment of this object include the ability to change barbell weights without having to physically lift up one end of the barbell, with the attendant increase in convenience and speed of changing out weights, and reduction in the chances of incurring injury while doing so.

It is another object of the present invention to provide an apparatus and method for changing barbell weights which can be used with existing barbells. Design features allowing this object to be accomplished include a ramp leading up to a cradle, which an existing barbell can be easily rolled onto. Benefits associated with the accomplishment of this object include obviation of the necessity of having to purchase new weight equipment, with the attendant increased convenience and cost savings.

It is still another object of this invention to provide a apparatus and method for changing barbell weights. Design steps enabling the accomplishment of this object include rolling a barbell up a ramp and into a cradle, such that an innermost weight of barbell resides on the cradle floor adjacent a cradle inner edge; removing or adding weights from the barbell as desired; and rolling the barbell out of the cradle, down the ramp, and off the stand. Advantages associated with the realization of this object include the ability to quickly and easily add and remove weights from an existing barbell without having to manually lift the barbell, and the attendant increased convenience and decreased risk of injury.

It is yet another object of this invention to provide a apparatus for changing barbell weights which is inexpensive to manufacture. Design features allowing this object to be achieved include the use of components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Four sheets of drawings are provided. Sheet one contains FIGS. 1 and 2. Sheet two contains FIGS. 3 and 4. Sheet three contains FIGS. 5 and 6. Sheet four contains FIGS. 7-9.

DETAILED DESCRIPTION OF THE PREFERRED EMBODIMENT

Figure 1:
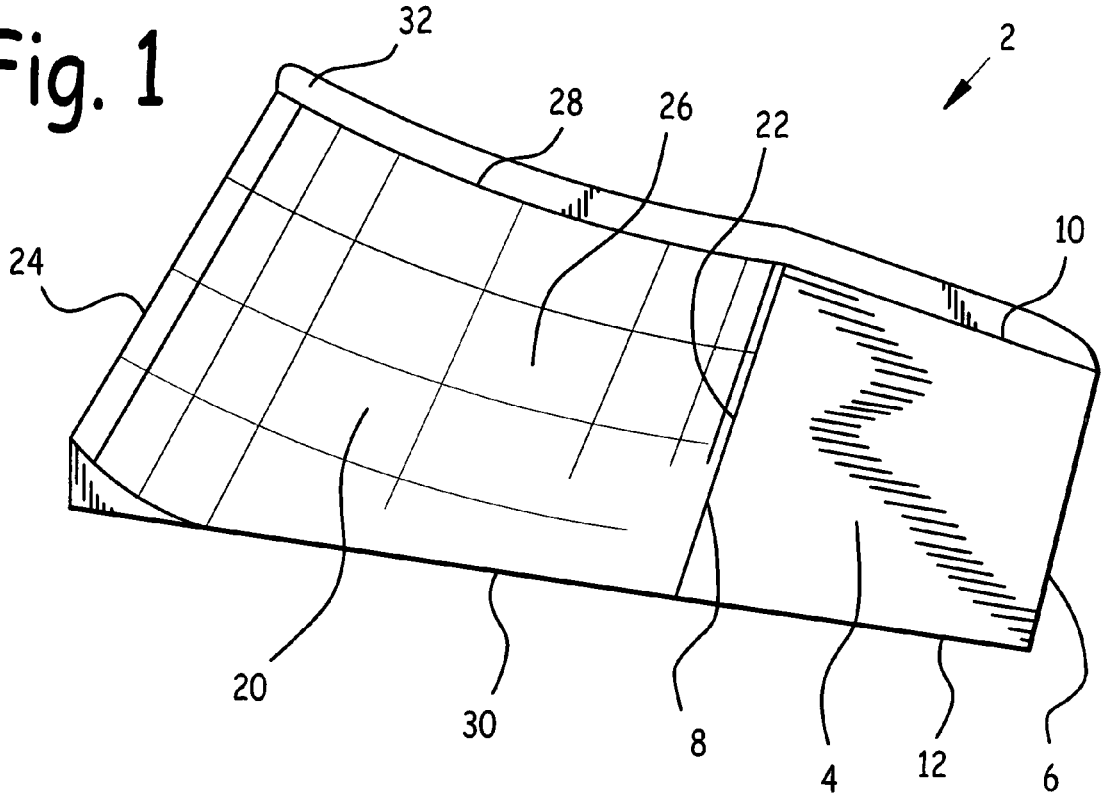
FIG. 1 is a left side elevated isometric view of a stand.

FIG. 1 is a side elevated isometric view of stand 2. Stand 2 comprises ramp 4 sloping up to cradle 20. Ramp 4 comprises ramp proximal end 6, ramp distal end 8 disposed adjacent cradle 20, ramp inner edge 10, and ramp outer edge 12. Ramp 4 slopes upwards from ramp proximal end 6 to ramp distal end 8. Ramp 4 also may slope downwards from ramp inner edge 10 to ramp outer edge 12.

Cradle 20 comprises cradle floor 26 bounded by cradle proximal lip 22 adjacent ramp distal end 8, and cradle distal lip 24 disposed along an edge of cradle 20 opposite cradle proximal lip 22. Cradle 20 further comprises cradle inner edge 28 and cradle outer edge 30 disposed opposite cradle inner edge 28. Cradle 20 slopes downwards from cradle inner edge 28 to cradle outer edge 30.

Figure 2:
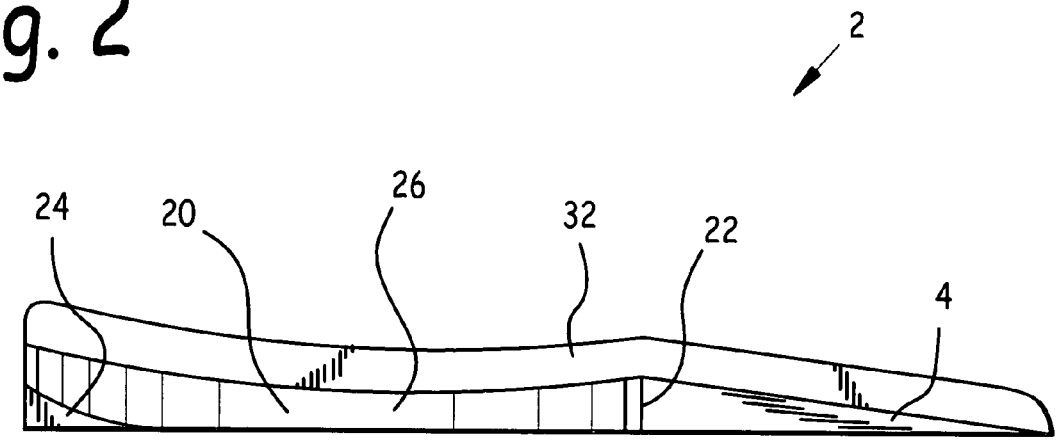
FIG. 2 is a left side view of a stand.

As may be observed in FIG. 2, a left side view of stand 20, cradle proximal lip 22 and cradle distal lip 24 are higher than cradle floor 26. Thus, a barbell rolled up ramp 4 and into cradle 20 will be constrained on cradle floor 26 by cradle proximal lip 22 and cradle distal lip 24. As may be observed in FIGS. 7-9, because cradle 20 slopes downwards from cradle inner edge 28 to cradle outer edge 30, a barbell 40 which has been rolled onto cradle 20 is supported solely by its innermost weight 44. Because barbell 40 is supported solely by its innermost weight 44, any weights other than the innermost weight 44 may be quickly and easily slid off or onto bar 42, because there is no frictional interference between downwardly-sloping cradle 20 and the weights 44 being slid off or onto bar 42.

Figure 5:
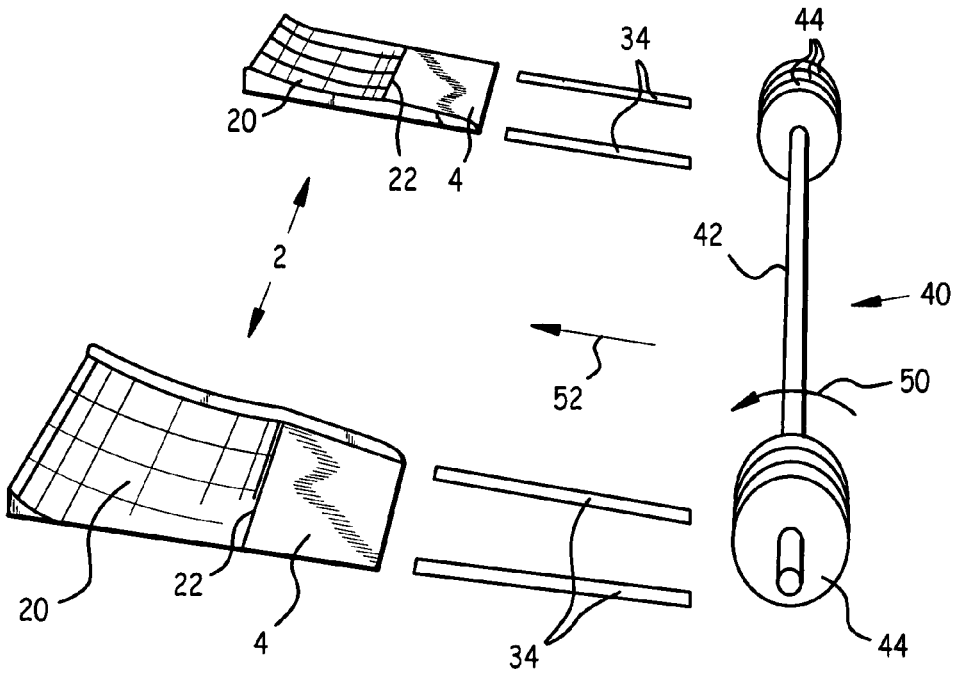
FIG. 5 is an elevated isometric view of a barbell about to be rolled onto a pair of stands.
Figure 6:
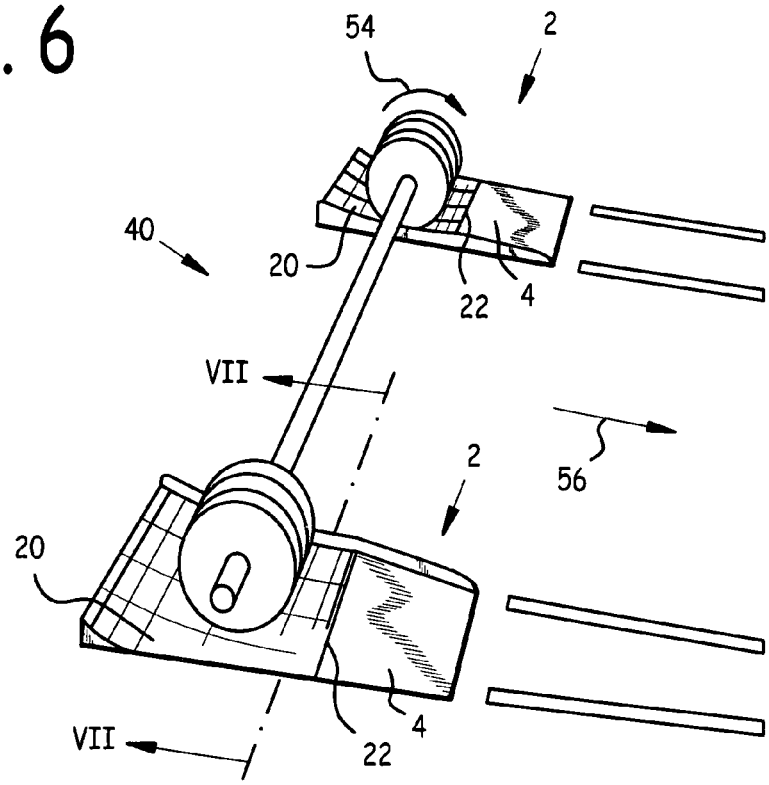
FIG. 6 is an elevated isometric view of a barbell which has been rolled onto a pair of stands.

Railing 32 may be installed along ramp inner edge 10 and cradle inner edge 28 to help constrain barbell 40 in the correct location atop stand 2, both when rolling onto and off of stand 2 as depicted in FIGS. 5 and 6, but also when stationary on cradle 20 as depicted in FIGS. 6-9.

Figure 3:
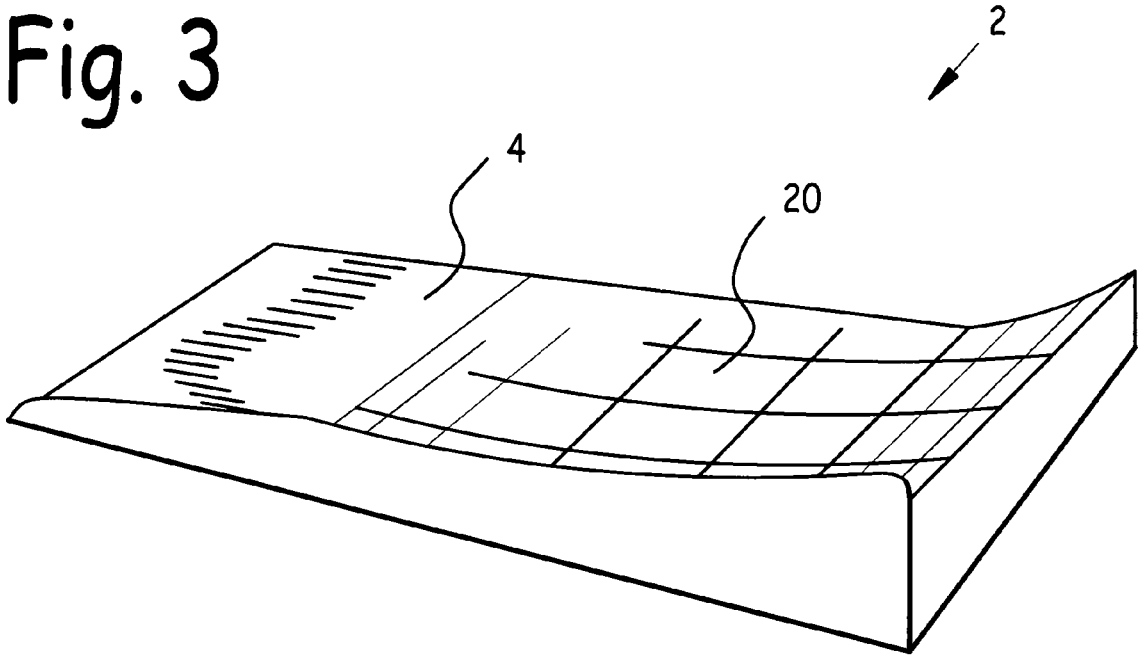
FIG. 3 is a right elevated isometric side view of a stand.
Figure 4:
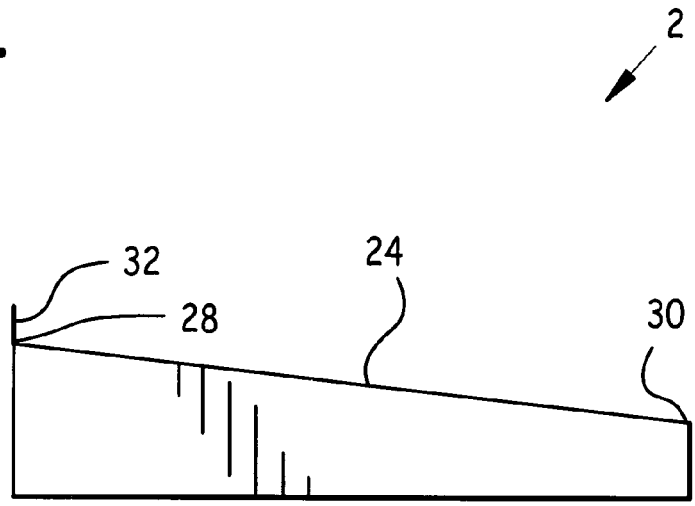
FIG. 4 is a rear view of a stand.

FIG. 3 is a right elevated isometric view of stand 2, showing ramp 4 leading to cradle 20. FIG. 4 is a rear view of stand 2, depicting cradle distal lip 24 sloping downwards from cradle inner edge 28 to cradle outer edge 30, and railing 32 along cradle inner edge 28.

FIG. 5 is an isometric view of barbell 40 about to be rolled onto a pair of stands 2. Barbell 40 rolls on circular weights 44 on bar 42. FIG. 6 is an isometric view of barbell 40 which has been rolled onto a pair of stands 2. A major advantage of the instant invention is the ability to roll barbell 40 up the gentle slope of ramp 4, over cradle proximal lip 22, and into cradle 20, as indicated by arrows 50 and 52 in FIG. 5. The ease of rolling an existing barbell 40 into and out of stand 2 is important, because even a small person or child can easily do so in order to change weights 44 on bar 42, and the instant apparatus is useable with existing barbells 40.

Rolling barbell 40 out of stand 2 is just as easy, because cradle proximal lip 22 is a minor ridge, and the slope from cradle floor 26 to cradle proximal lip 22 gentle, so that relatively little force is required to roll barbell 40 out of cradle 20 and over cradle proximal lip 22 as indicated by arrows 54 and 56 in FIG. 6. Once barbell 40 has been rolled out of cradle 20 and onto ramp 4, gravity assists barbell 40 in rolling down ramp 4 and off stand 2.

While FIGS. 5 and 6 depict a pair of stands 2 in use, a single stand 2 could as easily be used in order to change weights 44 on a single end of bar 42. Thus, a single stand 2 could be used to change weights on a single end of bar 42, or sequentially to change weights 44 on opposite ends of bar 42 by first rolling the stack of weights 44 on one end of bar 42 onto the stand 2, changing weights 44 as desired, rolling that stack of weights off stand 2, and then repeating these steps for the stack of weights 44 on the opposite end of bar 42.

The instant apparatus and method for changing barbell weights may comprise alignment indicia 34 on the surface upon which stand(s) 2 rest and upon which barbell 40 rolls. Alignment indicia 34 aid lining up barbell 40 to roll up stand (s) 2 parallel to ramp inner edge 10 and cradle inner edge 28, with the innermost weight(s) 44 in adjacent cradle inner edge (s) 28. In the preferred embodiment, alignment indicia 34 were strips disposed on the surface upon which stands 2 rest, on lines containing ramp inner edge 10 and said ramp outer edge 12 when viewed in plan view. Rolling a stack of weights 44 between these strips would correctly place barbell 44 to roll up ramp(s) 4 and into cradle(s) 20.

Figure 7:
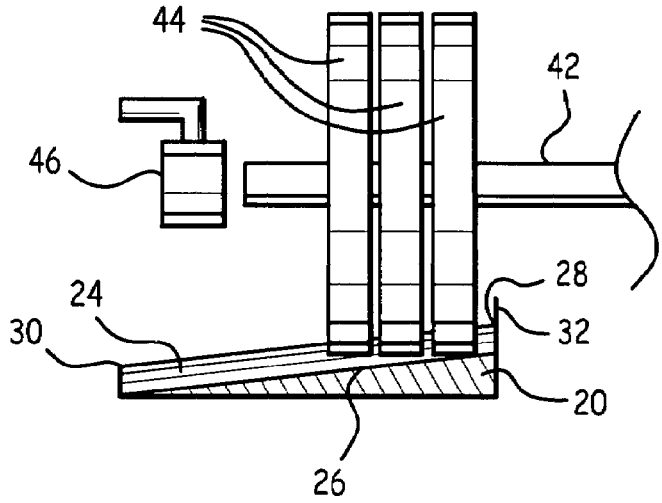
FIGS. 7-9 depict the instant method of removing and adding weights to a barbell, once the barbell has been rolled onto at least one stand.
Figure 8:
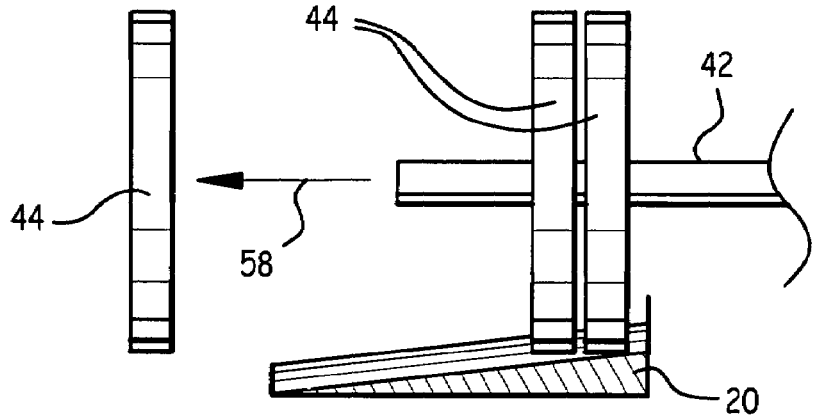
Figure 9:
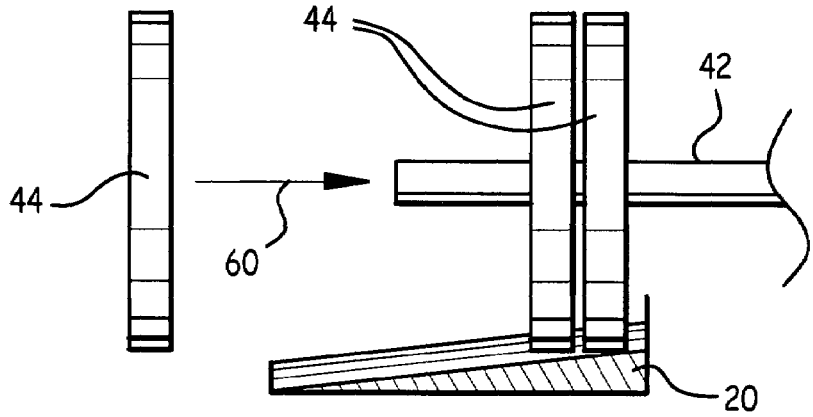

FIGS. 7-9 are cross-sectional views of a barbell in cradle 20 taken at section VII-VII of FIG. 6, depict the instant method of removing and adding weights 44 to a bar 42 after the barbell 40 has been rolled into cradle 20.

As may be observed in FIGS. 7-9, because cradle floor 26 slopes downward from cradle inner edge 28 to cradle outer edge 30, barbell 40 rests only on the innermost weight 44; all other weights other than the innermost weight 44 depend from bar 42 and may be therefore be easily slid onto and off of bar 42 without frictional interference with cradle floor 26, cradle proximal lip 22, or cradle distal lip 24.

Thus, weights 44 may be slid off bar 42 as indicated by arrow 58 in FIG. 8, or onto bar 42 as indicated by arrow 60 in FIG. 9, without having to lift bar 42 manually.

Referring now to FIG. 7, barbell 40 may comprise collar 46 which must be removed prior to adding or removing weights 44. After weights 44 are removed from and/or added to bar 42, collar 46 may be replaced to prevent weights 44 from sliding of the end of bar 42. Most barbells also incorporate a collar or stop on the opposite side of weights 44 from collar 46 (not shown in the instant figures) to prevent weights 44 from sliding inwards.

The cross-sectional shape of cradle 20 may be any appropriate shape incorporating cradle proximal lip 22 adjacent ramp 4, and cradle distal lip 24 along an edge of cradle 4 opposite cradle proximal lip 22. It is desirable that cradle floor 26 slope upwards gently to cradle proximal lip 22, so that little force is required to roll barbell 44 up from cradle floor 26 to cradle proximal lip 22, and thence down ramp 4 and off of stand 2. Cradle distal lip 24 could be any appropriate shape serving to prevent barbell 40 from rolling forward off of cradle 20, including a dam similar to railing 32 disposed along an edge of cradle 20 opposite ramp 4.

The cross-sectional shape of cradle 20 adjacent cradle inner edge 28 could approximate a circle of radius greater than the radius of inner weight 44. With this cradle 20 cross-sectional shape, inner weight 44 will roll, as urged by gravity, to the lowest point of cradle floor 26, much like a marble inside a wine glass will roll to the lowest point on the interior of that wine glass. Because the radius of curvature of cradle 20's cross-sectional shape is greater than the radius of curvature of inner weight 44, inner weight 44 touches cradle floor 26 at only its point of tangency with inner weight 44's circumference, and weights 44 other than inner weight 44 may be easily removed from or added to bar 42 without interference from cradle floor 26, cradle proximal lip 22, or cradle distal lip 24.

Thus, the instant method comprises the steps of:

A. Rolling a barbell 40 up ramp 4 and into cradle 20, such that an innermost weight 44 of barbell 40 is disposed on cradle floor 26 adjacent cradle inner edge 28;

B. Removing or adding weights 44 from bar 42 as desired;

C. Rolling barbell 40 out of cradle 20, down ramp 4, and off of stand 2.

The instant method may comprise the further steps of using alignment indicia 34 and/or railing 32 to facilitate rolling barbell 40 up ramp 4 and into cradle 20 such that an innermost weight 44 of barbell 40 is disposed on cradle floor 26 adjacent cradle inner edge 28, removing collar 46 from bar 42 prior to changing weights 44, and replacing collar 46 after changing weights 44.

In the preferred embodiment, stand 2 was made of plastic, nylon, rubber, synthetic, metal, wood, or other appropriate material. Alignment indicia 34 were strips of colorful or clearly visible material, and could incorporate reflective, metallic, holographic, or other appropriate finish. Barbell 40 was a commercially available, standard barbell.

While a preferred embodiment of the invention has been illustrated herein, it is to be understood that changes and variations may be made by those skilled in the art without departing from the spirit of the appending claims.

DRAWING ITEM INDEX

2 stand
4 ramp
6 ramp proximal end
8 ramp distal end
10 ramp inner edge
12 ramp outer edge
20 cradle
22 cradle proximal lip
24 cradle distal lip
26 cradle floor
28 cradle inner edge
30 cradle outer edge
32 railing
34 alignment indicia
40 barbell
42 bar
44 weight
46 collar
50 arrow
52 arrow
54 arrow
56 arrow

I claim:

1. An apparatus for changing barbell weights and a barbell comprising a circular weight, said apparatus for changing barbell weights comprising a stand, said stand comprising a ramp sloping up to a cradle, said cradle comprising a cradle floor disposed between a cradle proximal lip adjacent said ramp and a cradle distal lip along an edge of said cradle opposite said cradle proximal lip, said cradle further comprising a cradle inner edge extending from said cradle proximal lip to said cradle distal lip, and a cradle outer edge extending from said cradle proximal lip to said cradle distal lip and disposed opposite said cradle inner edge, said cradle floor sloping downward from said cradle inner edge to said cradle outer edge relative to a surface upon which said apparatus for changing barbell weights rests, said ramp comprising a ramp proximal end opposite a ramp distal end, and a ramp inner edge opposite a ramp outer edge, said ramp distal end being disposed adjacent said cradle proximal lip, said ramp sloping downwards from said ramp distal end to said ramp proximal end, and said ramp sloping downwards from said ramp inner edge to said ramp outer edge, said cradle floor sloping gently up to said cradle proximal lip, said cradle floor sloping gently up to said cradle distal lip, a cross-sectional shape of said cradle adjacent said cradle inner edge being substantially circular, a radius of curvature of said cross-sectional shape of said cradle adjacent said cradle inner edge exceeding a radius of curvature of said weight.

2. The apparatus for changing barbell weights of claim 1 further comprising alignment indicia disposed on lines containing said ramp inner edge and said ramp outer edge when viewed in plan view.

3. A method for changing barbell weights using an apparatus for changing barbell weights comprising a stand, said stand comprising a ramp sloping up to a cradle, said cradle comprising a cradle floor disposed between a cradle proximal lip adjacent said ramp and a cradle distal lip along an edge of said cradle opposite said cradle proximal lip, said cradle further comprising a cradle inner edge and a cradle outer edge, said cradle floor sloping downward from said cradle inner edge to said cradle outer edge, said method comprising the steps of:

A. Rolling a barbell having at least one circular weight up said ramp and into said cradle, whereby an innermost said weight is disposed on said cradle floor adjacent said cradle inner edge;

B. Removing or adding weights from said barbell as desired; and

C. Rolling said barbell out of said cradle, down said ramp, and off of said stand.

4. The method for changing barbell weights of claim 3 wherein said apparatus for changing barbell weights further comprises a ramp inner edge, and a railing along said ramp inner edge and said cradle inner edge, and said method comprises the further step of rolling said at least one weight up said ramp adjacent said railing, and into said cradle adjacent said railing, whereby said railing acts as a guide to roll said barbell into said cradle.

5. The method for changing barbell weights of claim 3 wherein said apparatus to change barbell weights further comprises alignment indicia on a surface upon which said stand rests, whereby said barbell may be properly aligned so as to roll up said ramp and into said cradle.

6. The method for changing barbell weights of claim 5 wherein said alignment indicia comprise strips on said surface disposed on lines containing said ramp inner edge and said ramp outer edge when viewed in plan view.

7. An apparatus for changing barbell weights and a barbell comprising a circular weight, said apparatus for changing barbell weights comprising a pair of stands, each said stand comprising a ramp sloping up to a cradle, each said cradle comprising a cradle floor disposed between a cradle proximal lip adjacent said ramp and a cradle distal lip along an edge of said cradle opposite said cradle proximal lip, each said cradle further comprising a cradle inner edge extending from said cradle proximal lip to said cradle distal lip, end a cradle outer edge extending from said cradle proximal lip to said cradle distal lip and disposed opposite said cradle inner edge, each said cradle floor sloping downward from said cradle inner edge to said cradle outer edge relative to a surface upon which said apparatus for changing barbell weights rests, each said ramp comprising a ramp proximal end opposite a ramp distal end, and a ramp inner edge opposite a ramp outer edge, said ramp distal end being disposed adjacent said cradle proximal lip, said ramp sloping downwards from said ramp distal end to said ramp proximal end, said ramp sloping downwards from said ramp inner edge to said ramp outer edge, said stands being spaced apart a distance substantially equal to a distance between weight stacks on said barbell, a cross-sectional shave of each said cradle adjacent respective said cradle inner edges being substantially circular, a radius of curvature of said cross-sectional shave of each said cradle adjacent said cradle inner edge exceeding a radius of curvature of said weight.

8. A method for changing barbell weights using an apparatus for changing barbell weights comprising a pair of stands, said stands being spaced apart a distance substantially equal to a distance between circular weights at each end of a barbell, each said stand comprising a ramp sloping up to a cradle, each said cradle comprising a cradle floor disposed between a cradle proximal lip adjacent said ramp and a cradle distal lip along an edge of said cradle opposite said cradle proximal lip, said cradle further comprising a cradle inner edge and a cradle outer edge, said cradle floor sloping downward from said cradle inner edge to said cradle outer edge, said method comprising the steps of:

A. Rolling at least one said barbell weight up each said ramp and into respective said cradles, whereby an innermost said weight is disposed on each said cradle floor adjacent said cradle inner edge;

B. Removing or adding weights from said barbell as desired; and

C. Rolling said barbell out of said cradle, down said ramp, and off of said stand.

9. The method for changing barbell weights of claim 8 wherein each said stand further comprises a ramp inner edge, and a railing along said ramp inner edge and said cradle inner edge, and said method comprises the further step of rolling said at least one weight up one said ramp adjacent a respective said railing, and into one said cradle adjacent a respective said railing, whereby said railing acts as a guide to roll said barbell into at least one said cradle.

10. The method for changing barbell weights of claim 8 wherein said apparatus to change barbell weights further comprises alignment indicia on a surface upon which said stands rest, whereby said barbell may be properly aligned so as to roll up said ramps and into said cradles.

11. The method for changing barbell weights of claim 10 wherein said alignment indicia comprise strips on said surface disposed on lines containing said ramp inner edges and said ramp outer edges when viewed in plan view.

* * * * *

UNITED STATES PATENT AND TRADEMARK OFFICE

CERTIFICATE OF CORRECTION

PATENT NO. : 7,637,852 B2
APPLICATION NO. : 11/784351
DATED : December 29, 2009
INVENTOR(S) : Richard J. Hoole It is certified that error appears in the above-identified patent and that said Letters Patent is hereby corrected as shown below:

Column 1 Line 37:

Is: "...U.S. Pat. No. 2004/0162197..."
Should Be: "...US 2004/0162197..."

Column 6 Line 38:

Is: "...cradle distal lip, end..."
Should be: "...cradle distal lip, and..."

Column 6 Line 51:

Is: "...shave..."
Should be: "...shape…"

Column 6 Line 54:

Is: "...shave..."
Should be: "...shape..."

Signed and Sealed this

Twentieth Day of April, 2010

David J. Kappos

David J. Kappos
*Director of the United States Patent and Trademark Office*